US007097524B2

(12) United States Patent
Arias

(10) Patent No.: US 7,097,524 B2
(45) Date of Patent: Aug. 29, 2006

(54) COLLAPSIBLE FLOTATION DEVICE

(75) Inventor: David Arias, Virginia Beach, VA (US)

(73) Assignee: Kelsyus, LLC, Virginia Beach, VA (US)

( * ) Notice: Subject to any disclaimer, the term of this patent is extended or adjusted under 35 U.S.C. 154(b) by 202 days.

(21) Appl. No.: 10/295,906

(22) Filed: Nov. 18, 2002

(65) Prior Publication Data

US 2003/0068940 A1 Apr. 10, 2003

Related U.S. Application Data

(63) Continuation of application No. 09/772,739, filed on Jan. 30, 2001, now Pat. No. 6,485,344.

(60) Provisional application No. 60/238,988, filed on Oct. 10, 2000.

(51) Int. Cl.
*B63C 9/08* (2006.01)

(52) U.S. Cl. ..... 441/131

(58) Field of Classification Search ..... 446/46–48, 446/153, 220, 487; 114/345; 441/40, 43, 441/80, 81, 125, 129, 130, 131, 136; 472/129
See application file for complete search history.

(56) References Cited

U.S. PATENT DOCUMENTS

| | | | |
|---|---|---|---|
| 722,801 | A | 3/1903 | Bourne, Jr. |
| 772,690 | A | 10/1904 | Baswitz |
| 856,279 | A | 6/1907 | Moore |
| 1,190,743 | A | 7/1916 | Fageol |
| 1,479,903 | A | 1/1924 | Erland |
| 1,960,474 | A | 5/1934 | Browne |
| 2,119,023 | A | 5/1938 | Pickard |
| 2,173,963 | A | 9/1939 | Eubank |
| 2,190,566 | A | 2/1940 | Julian |
| 2,207,025 | A | 7/1940 | Rison |
| 2,334,924 | A | 11/1943 | Hansen |
| 2,344,010 | A | 3/1944 | Walsh |
| 2,357,789 | A | 9/1944 | Levy |
| 2,360,715 | A | 10/1944 | Perry |
| 2,420,344 | A | 5/1947 | Alexander |
| 2,442,105 | A | 5/1948 | Vacheron |
| 2,637,861 | A | 5/1953 | Kethledge |
| 2,731,997 | A | 1/1956 | Muth et al. |

(Continued)

FOREIGN PATENT DOCUMENTS

| | | |
|---|---|---|
| EP | 0 974 293 A2 | 1/2000 |
| GB | 258077 | 9/1926 |

OTHER PUBLICATIONS

*Swimways Corp., v. Overbreak, LLC*, Order, Case No. 1:04cv627, dated Jan. 18, 2005.

*Swimways Corp., v. Overbreak, LLC*, Memorandum Opinion, Case No. 1:04cv627, dated Jan. 21, 2005.

*Primary Examiner*—Andrew D. Wright

(57) ABSTRACT

A device comprises a spring and a sleeve. The spring is configured to form a closed loop. The spring is moveable between a coiled configuration when the spring is collapsed and an uncoiled configuration when the spring is expanded. The spring defines a circumference while in the uncoiled configuration. The spring is disposed within the sleeve. The sleeve includes an inflatable portion disposed about at least a portion of the circumference.

37 Claims, 5 Drawing Sheets

U.S. PATENT DOCUMENTS 2,803,291 A 8/1957 Meyer
2,803,839 A 8/1957 Mosley
2,870,464 A 1/1959 Lalick
3,052,895 A 9/1962 Lo Vico
3,336,610 A 8/1967 Geddings
3,339,218 A 9/1967 Stamberger
3,602,930 A 9/1971 Channon
3,775,782 A 12/1973 Rice et al.
3,842,454 A 10/1974 Young
3,860,976 A 1/1975 Suyama
3,862,876 A 1/1975 Graves
3,960,161 A 6/1976 Norman
3,990,463 A 11/1976 Norman
4,097,944 A 7/1978 Yulish
4,200,942 A 5/1980 Case
4,231,125 A 11/1980 Tittl
D261,464 S 10/1981 Smith
4,296,788 A 10/1981 Slater
4,478,587 A 10/1984 Mackal
4,512,049 A 4/1985 Henry
4,561,480 A 12/1985 Underwood et al.
4,576,375 A 3/1986 Roberts
4,709,430 A 12/1987 Nicoll
4,766,918 A 8/1988 Oderkirk
4,815,784 A 3/1989 Zheng
4,825,892 A 5/1989 Norman
4,858,634 A 8/1989 McLeese
4,942,838 A 7/1990 Boyer et al.
4,944,707 A * 7/1990 Silverglate ..... 446/48
4,946,067 A 8/1990 Kelsall
4,951,333 A 8/1990 Kaiser et al.
4,976,642 A 12/1990 Wilkie
5,024,262 A 6/1991 Huang
5,038,812 A 8/1991 Norman
5,045,011 A * 9/1991 Lovik ..... 446/46
5,056,172 A 10/1991 Kaiser et al.
5,059,463 A 10/1991 Peters
5,070,807 A 12/1991 Lewis
D325,489 S 4/1992 Pratt
5,116,273 A 5/1992 Chan
5,123,869 A * 6/1992 Schipmann ..... 446/46
D328,324 S 7/1992 Wang
5,163,192 A 11/1992 Watson
5,163,461 A 11/1992 Ivanovich et al.
5,186,667 A 2/1993 Wang
5,206,964 A 5/1993 Wilson, Sr.
5,213,147 A 5/1993 Zheng
5,261,131 A 11/1993 Kilby
5,299,331 A 4/1994 Badillo
D349,593 S 8/1994 Hensley
5,334,067 A 8/1994 Henry et al.
5,345,627 A 9/1994 Cammarata
5,358,440 A * 10/1994 Zheng ..... 446/48
5,385,518 A 1/1995 Turner
5,396,917 A 3/1995 Hazinski et al.
5,430,980 A 7/1995 Ferrier
5,433,433 A 7/1995 Armell
5,435,025 A 7/1995 Gerard et al.
5,454,643 A 10/1995 Sullivan
5,467,794 A 11/1995 Zheng
D366,177 S 1/1996 Dean
5,520,561 A 5/1996 Langenohl
5,533,653 A 7/1996 Kaufman
5,560,385 A 10/1996 Zheng
5,571,036 A 11/1996 Hannigan
5,579,799 A 12/1996 Zheng
5,592,961 A 1/1997 Chin
D378,772 S 4/1997 Hall
5,618,110 A 4/1997 Sullivan
5,618,246 A 4/1997 Zheng
5,619,759 A 4/1997 Hansen et al.
RE35,571 E 7/1997 McLeese
5,644,807 A 7/1997 Battistella
5,688,052 A 11/1997 Compton
5,693,398 A 12/1997 Granger
D389,362 S 1/1998 Boulatian
5,718,612 A 2/1998 Elsholz
5,729,846 A 3/1998 Sullivan
5,730,529 A 3/1998 Fritz et al.
5,810,695 A 9/1998 Sass
D400,749 S 11/1998 Bechtold, Jr.
5,885,123 A 3/1999 Clifford
5,976,023 A 11/1999 Cho
6,030,300 A 2/2000 Zheng
D425,357 S 5/2000 Waring
D426,415 S 6/2000 Le Gette et al.
6,073,283 A 6/2000 Zheng
6,113,453 A 9/2000 Stuffelbeam
6,170,100 B1 1/2001 Le Gette et al.
6,192,635 B1 2/2001 Zheng
6,223,673 B1 5/2001 Mears et al.
6,225,940 B1 5/2001 Ohlsen
6,276,979 B1 8/2001 Saltel
D447,661 S 9/2001 Le Gette et al.
D449,193 S 10/2001 Le Gette et al.

* cited by examiner

COLLAPSIBLE FLOTATION DEVICE

CROSS REFERENCE TO RELATED APPLICATION

The present application is a continuation of U.S. application Ser. No. 09/772,739, now U.S. Pat. No. 6,485,344, filed Jan. 30, 2001, the disclosure of which is incorporated herein by reference, and which claims the benefit of U.S. Provisional Application Ser. No. 60/238,988, filed Oct. 10, 2000.

BACKGROUND OF THE INVENTION

1. Field of the Invention

The present invention relates to inflatable flotation devices. In particular, the present invention relates to inflatable flotation devices which are collapsible through use of a spring mechanism.

2. Description of the Related Art

Inflatable flotation devices are well known in the form of floats, rafts, lifeboats, life preservers and other like devices. Previously known devices generally maintain their shape through air pressure alone and generally collapse when deflated.

In one of many examples, U.S. Pat. No. 3,775,782 issued to Rice et al. describes an inflatable rescue raft. When deflated, the raft can be rolled into a compact size.

Also well known in the art are collapsible items which are collapsible through the use of a collapsible metal or plastic spring. U.S. Pat. No. 4,815,784 shows an automobile sun shade which uses these collapsible springs. The springs are also used in children's play structures (U.S. Pat. Nos. 5,618,246 and 5,560,385) and tent-like shade structures (U.S. Pat. Nos. 5,579,799 and 5,467,794).

The collapsible springs are typically retained or held within fabric sleeves provided along the edges of a piece of fabric or other panel. The collapsible springs may be provided as one continuous loop, or may be a strip or strips of material connected at the ends to form a continuous loop. These collapsible springs are usually formed of flexible coilable steel, although other materials such as plastics are also used. The collapsible springs are usually made of a material which is relatively strong and yet is flexible to a sufficient degree to allow it to be coiled. Thus, each collapsible spring is capable of assuming two configurations, a normal uncoiled or expanded configuration, and a coiled or collapsed configuration in which the spring is collapsed into a size which is much smaller than its open configuration. The springs may be retained within the respective fabric sleeves without being connected thereto. Alternatively, the sleeves may be mechanically fastened, stitched, fused, or glued to the springs to retain them in position.

SUMMARY OF THE DISCLOSURE

A device comprises a spring and a sleeve. The spring is configured to form a closed loop. The spring is moveable between a coiled configuration when the spring is collapsed and an uncoiled configuration when the spring is expanded. The spring defines a circumference while in the uncoiled configuration. The spring is disposed within the sleeve. The sleeve includes an inflatable portion disposed about at least a portion of the circumference.

It is therefore an object of the present invention to provide a collapsible flotation device.

It is another object of the present invention to provide a collapsible flotation device which is easily collapsed and extended to full size through a mechanical means.

It is yet another object of the present invention to provide a collapsible flotation device which is easily collapsed and extended to fall size through the use of a spring.

It is yet a further object of the present invention to provide a collapsible flotation device which requires minimal force to twist and fold into the collapsed configuration.

Finally, it is an object of the present invention to accomplish the foregoing objectives in a simple and cost effective manner.

DETAILED DESCRIPTION OF THE PREFERRED EMBODIMENTS

Figure 1:
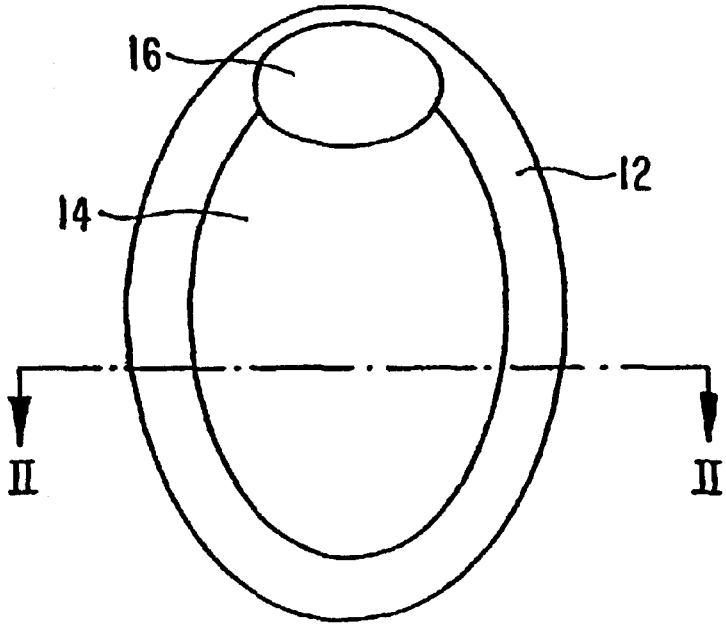
FIG. 1 is a top view of the preferred embodiment of the present invention.

The following detailed description is of the best presently contemplated modes of carrying out the invention. This description is not to be taken in a limiting sense, but is made merely for the purpose of illustrating general principles of embodiments of the invention.

The present invention provides a collapsible flotation device. The device includes a coilable metal or plastic spring. The coilable spring can be made from other materials, however, it is important that the coilable spring be made from a material that is strong and flexible. The spring must be coilable such that it folds on top of itself to become more compact. In its uncoiled state, the coilable spring can be round or oval or any shape satisfactory for use as a flotation device. Because it is to be used in water, the coilable spring is preferably either manufactured from a waterproof material or coated to protect any material which is not waterproof. The coilable spring can be a single continuous element or can include a joining means, such as a sleeve, for joining the ends of one or more spring elements together. The coilable spring can be of any appropriate shape and dimension. The coilable spring also has memory such that is biased to return to its uncoiled configuration when not held in the coiled configuration.

Stretched across the coilable spring is a flexible panel of material. The flexible panel can be one continuous piece or can be made up of several different types of material. In a preferred embodiment, the center portion of the flexible panel is mesh to allow water to flow through while the perimeter edges are nylon or polyester. At the edges of the flotation device, the material is a double thickness, forming a pocket around the perimeter of the flotation device. In this pocket are one or more inflatable chambers. One inflatable chamber may surround the entire perimeter of the flotation device or it may be divided into two or more inflatable chambers with each inflatable chamber having a means for inflating and deflating the inflatable chamber. In a preferred embodiment, one inflatable chamber is specifically designed to accommodate the user's head. In this embodiment, the pocket formed by the material is wider along a small portion of the perimeter of the flotation device to allow for a wider inflatable chamber. This will prevent the user's head from sinking below the rest of the user's body. The size of the inflatable chamber can vary significantly and need only be as wide as necessary to support the user's body weight. A preferred embodiment includes an inflatable chamber which is 3 inches in diameter when inflated. The inflatable chamber can be made from any appropriate float material but is preferably resistant to punctures. The coilable spring may also be located within the perimeter pocket. If one inflatable chamber is selected, the coilable spring can be placed inside or outside the inflatable chamber. If multiple inflatable chambers are used, the coilable spring will be outside the inflatable chambers. Alternatively, the coilable spring may be located outside the perimeter pocket along the outer edge of the flotation device. The coilable spring may be attached to the flexible panel through mechanical means such as fastening, stitching, fusing, or gluing.

Figure 2:
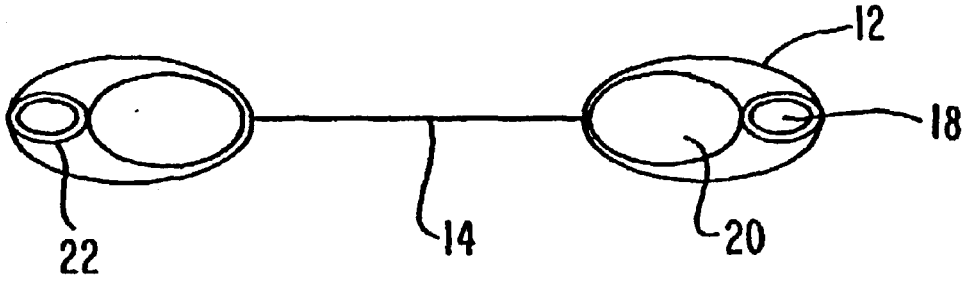
FIG. 2 is a cross sectional view of the preferred embodiment of the present invention taken along line II—II of FIG. 1.
Figure 3:
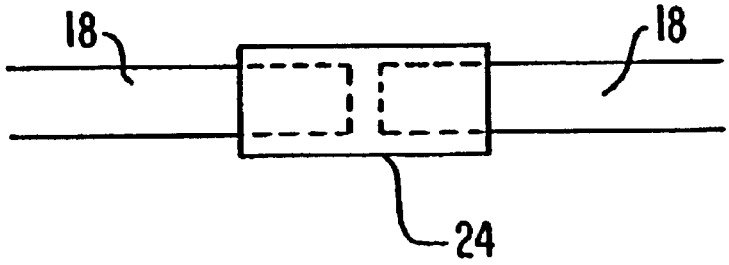
FIG. 3 is a view of a joining method as used in one embodiment of the present invention.

A preferred embodiment of the flotation device is shown in FIGS. 1 and 2 in its expanded configuration. The perimeter pocket 12 portion of the flexible panel is nylon while the central portion 14 of the flexible panel is made from a mesh material. The pillow 16 is part of the perimeter pocket 12 as it includes a double layer of fabric to accept an inflatable chamber 20 between the layers of fabric. In this particular embodiment, there are two inflatable chambers 20 in the perimeter pocket of the flotation device and one in the pillow 16, each of which includes a means for inflating the inflatable chamber 20. The inflation means is a valve on the underside of the flotation device. The inflatable chambers 20 in the perimeter pocket of the flotation device expand to approximately a 3-inch diameter when inflated. The coilable spring 18 is made from flexible, collapsible steel and is coated with a layer of PVC 22 to protect the coilable spring 18 from corroding and rusting due to contact with water during normal use of the flotation device. The coilable spring 18 also has memory such that will open to its uncoiled configuration when not held in the coiled configuration. The coilable spring 18 can be a single unitary element or can include sleeves 24 for joining the ends of one or more strips as shown in FIG. 3 in which the ends of the coilable spring 18 within the sleeve 24 are shown in dashed lines for clarification.

Figure 4:
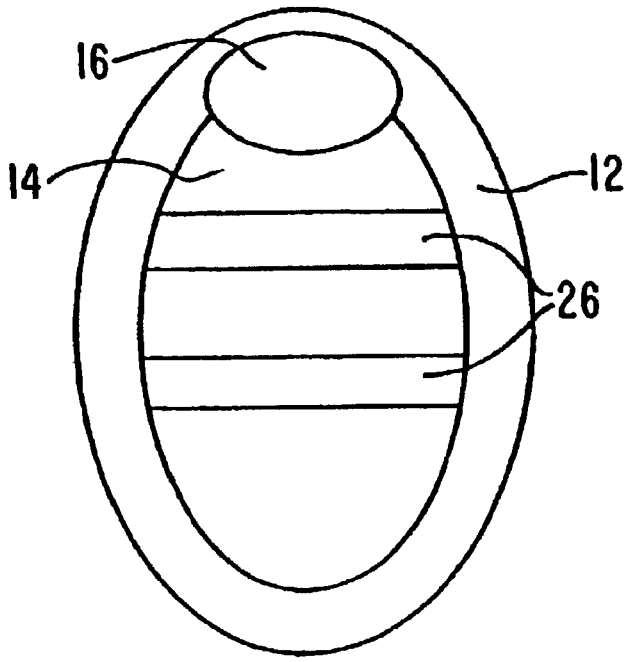
FIG. 4 is a top view of an alternate embodiment of the present invention.
Figure 5:
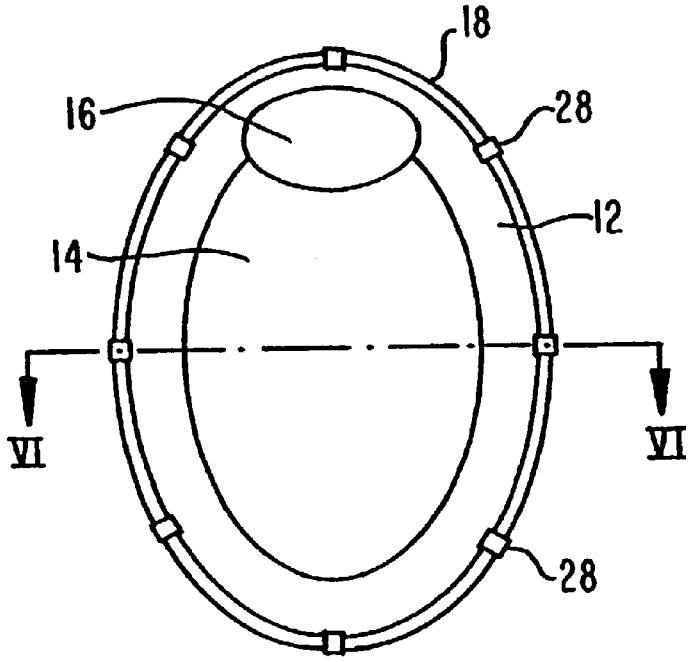
FIG. 5 is a top view of another alternate embodiment of the present invention.
Figure 6:
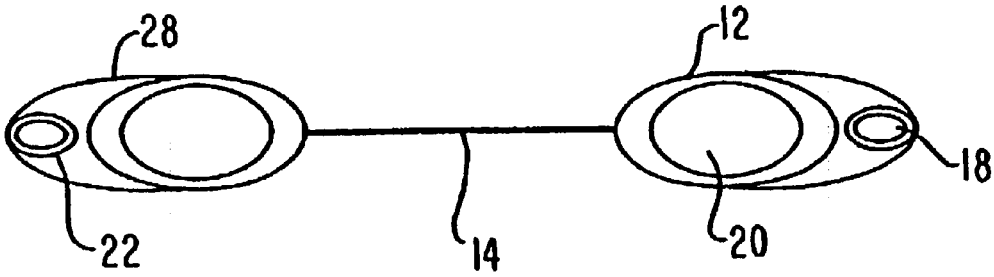
FIG. 6 is a cross section view of the alternate embodiment of the present invention across line VI—VI of FIG. 5.
Figure 7:
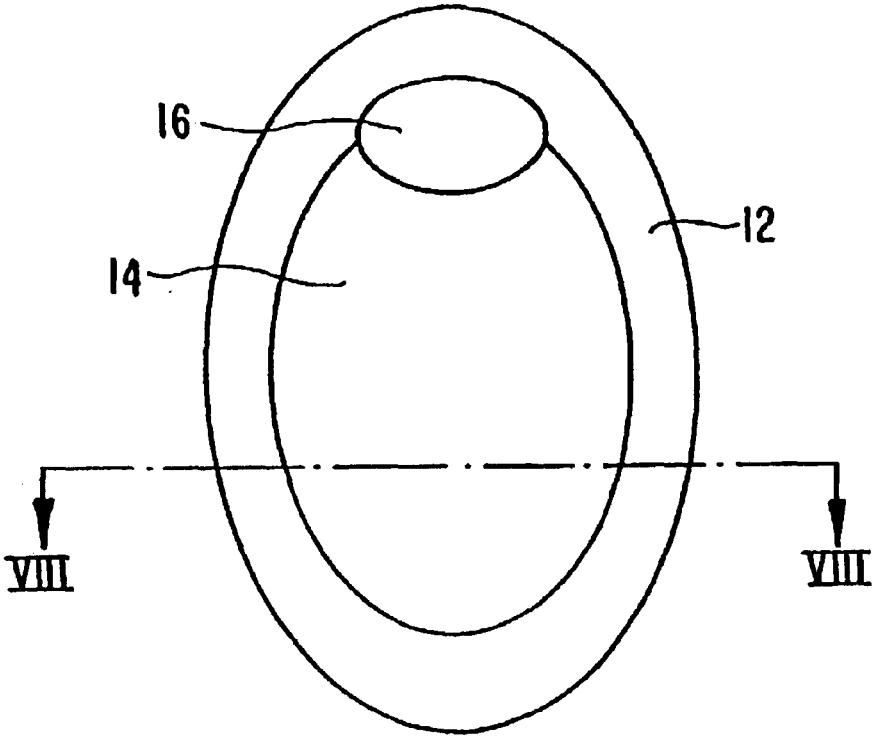
FIG. 7 is a top view of an alternative embodiment of the present invention.
Figure 8:
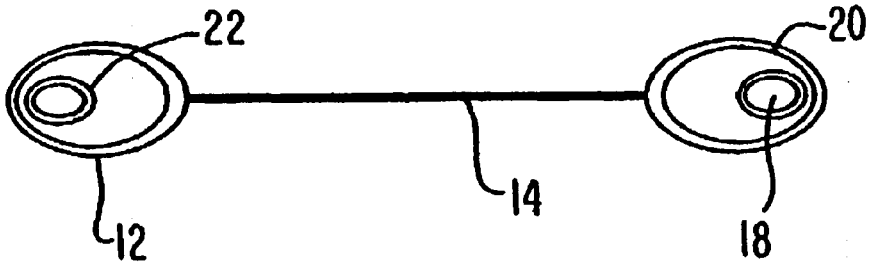
FIG. 8 is a cross sectional view of the embodiment of the present invention, taken along line VIII—VIII of FIG. 7.
Figure 9:
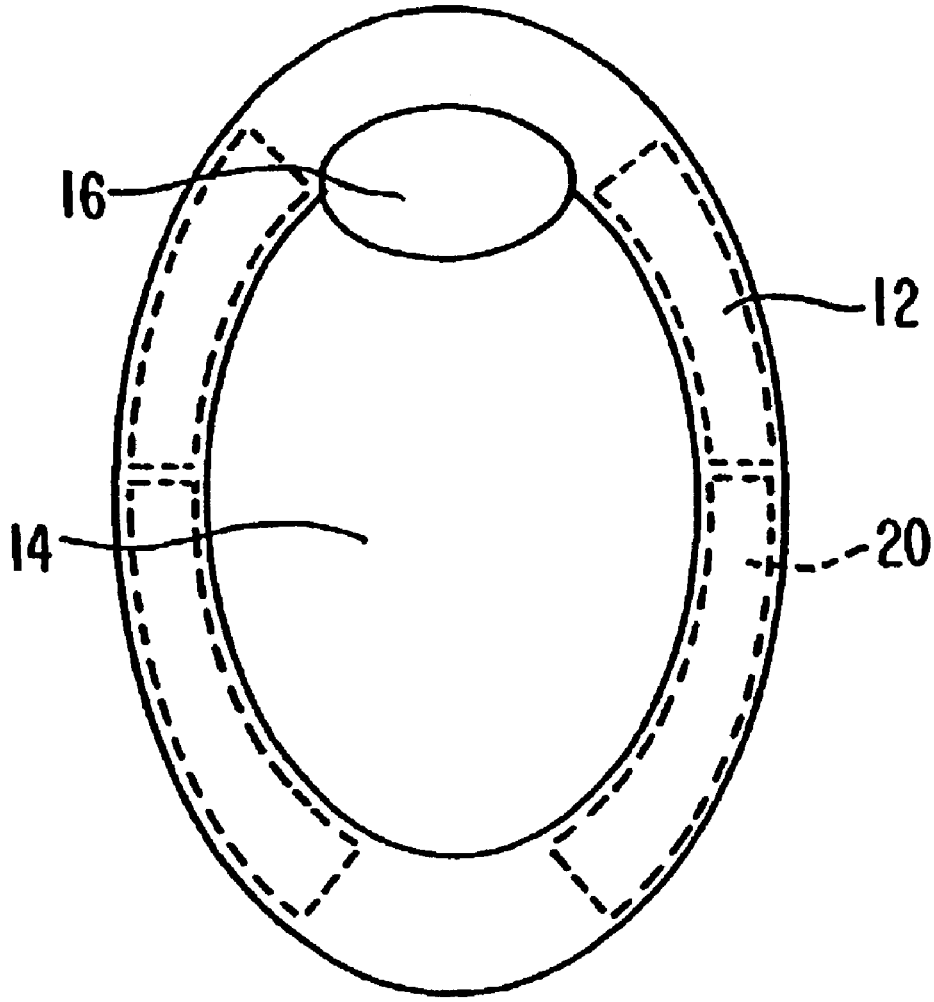
FIG. 9 is a plan view of another embodiment of the present invention.

Alternatively or in addition to the perimeter inflatable chambers, the device can include inflatable chambers 26 which cross the panel as shown in FIG. 4. FIGS. 5 and 6 show a further alternate embodiment of the present invention in which the coilable spring 18 is attached to the external perimeter of the pocket portion 12 of the flexible panel through the use of a mechanical means. In this particular embodiment, several loops 28 are used to attach the coilable spring 18 to the pocket portion 12 of the flexible panel.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A device, comprising:

a spring configured to form a closed loop, the spring being moveable between a coiled configuration when the spring is collapsed and an uncoiled configuration when the spring is expanded, the spring defining an interior area within at least a portion of the closed loop when the spring is in the uncoiled configuration;

a membrane disposed within the interior area; and an inflatable bladder being coupled to and disposed circumferentially about at least a portion of the spring, the device being configured to support a body weight of a user.

2. The device of claim 1, wherein the portion of the spring is disposed within the inflatable bladder.

3. The device of claim 1, wherein the spring is disposed outside of and proximate to the inflatable bladder.

4. The device of claim 1, the membrane is a first membrane, the device further comprising:

a second membrane folded over the spring and configured to retain the spring; and a sleeve within which the inflatable bladder is disposed.

5. The device of claim 1, the inflatable bladder being a first inflatable bladder, further comprising:

a pillow section configured to encapsulate a second inflatable bladder, the pillow section being coupled to the membrane.

6. A device, comprising:

a spring configured to form a closed loop, the spring being moveable between a coiled configuration when the spring is collapsed and an uncoiled configuration when the spring is expanded, the spring defining a circumference while in the uncoiled configuration; and a sleeve within which the spring is disposed, the sleeve including an inflatable portion disposed about at least a portion of the circumference, the device being configured to support a body weight of a user.

7. The device of claim 6, wherein the spring is disposed within the inflatable portion of the sleeve.

8. The device of claim 6, wherein the spring is disposed outside of and proximate to the inflatable portion of the sleeve.

9. The device of claim 6, further comprising:

a panel, the sleeve defining an interior area within at least a portion of the closed loop when the spring is in the uncoiled configuration, the panel being disposed within the interior area.

10. The device of claim 6, further comprising:

a pillow section configured to encapsulate an inflatable bladder, the pillow section being coupled to the sleeve.

11. A device, comprising:

a spring configured to form a closed loop, the spring being moveable between a coiled configuration when the spring is collapsed and an uncoiled configuration when the spring is expanded, the spring defining a circumference when the spring is in the uncoiled configuration; and a plurality of inflatable bladders being coupled to and disposed about at least a portion of the circumference, the device being configured to support a body weight of a user.

12. The device of claim 11, wherein:

the plurality of inflatable bladders includes a first inflatable bladder and a second inflatable bladder, the first inflatable bladder being disposed within a sleeve, the second inflatable bladder being disposed within a pillow section.

13. The device of claim 11, further comprising:

a sleeve within which the spring and at least a portion of the plurality of inflatable bladders are disposed.

14. The device of claim 11, further comprising:

a membrane folded over and configured to retain at least a portion of the spring; and a sleeve within which the plurality of inflatable bladders are disposed.

15. The device of claim 11, further comprising:

a membrane folded over and retaining at least a portion of the spring, the membrane having a first end and a second end; and a sleeve within which the plurality of inflatable bladders is disposed, the first end of the membrane and the second end of the membrane being coupled to the sleeve.

16. A device, comprising:

a spring being moveable between a coiled configuration when the spring is collapsed and an uncoiled configuration when the spring is expanded, the spring defining a circumference while in the uncoiled configuration, the circumference including a first circumference portion and a second circumference portion different from the first circumference portion;

a first set of inflatable bladders disposed about the first circumference portion, the first set of inflatable bladders having at least one inflatable bladder; and a second set of inflatable bladders disposed about the second circumference portion, the second set of inflatable bladders having at least one inflatable bladder, the device being configured to support a body weight of a user.

17. The device of claim 16, further comprising:

a sleeve, the spring being disposed within the sleeve; and a pillow section, at least one of the inflatable bladders of the second set of inflatable bladders being encapsulated within the pillow section.

18. The device of claim 16, further comprising:

a sleeve, the first set of inflatable bladders being disposed within the sleeve, the spring being disposed within the sleeve and outside of the first set of inflatable bladders.

19. The device of claim 16, further comprising:

a sleeve, the first set of inflatable bladders and the second set of inflatable bladders being disposed within the sleeve.

20. The device of claim 16, further comprising:

a sleeve, the first set of inflatable bladders being disposed within the sleeve; and a membrane, the spring being coupled to the sleeve by the membrane.

21. A collapsible device, comprising:

a panel including an inner portion and an outer portion;

a spring disposed about the outer portion of the panel, the spring being movable between a coiled configuration and an uncoiled configuration;

a support member traversing the panel, the support member including a first end and a second end coupled respectively to a first location and a second location of the outer portion of the panel, the inner portion of the panel being disposed proximate to the support member; and an inflatable bladder disposed about at least a part of the outer portion of the panel and coupled to the support member, the inflatable bladder being configured to buoyantly support a body weight of a user disposed on the panel.

22. The collapsible device of claim 21, further comprising:

a sleeve disposed about the outer portion of the panel, the spring being disposed within the sleeve.

23. The collapsible device of claim 21, wherein the inner portion includes a water-permeable material.

24. The collapsible device of claim 23, wherein the water-permeable material is a mesh material.

25. The collapsible device of claim 21, wherein the inflatable bladder is a first inflatable bladder from a plurality of inflatable bladders.

26. The collapsible device of claim 25, wherein the plurality of inflatable bladders includes a second inflatable bladder coupled along at least a portion of the support member.

27. The device of claim 1, wherein the device is further configured such that a head of the user is prevented from sinking below a remaining portion of the user.

28. A device, comprising:

a spring configured to form a closed loop, the spring being moveable between a coiled configuration when the spring is collapsed and an uncoiled configuration when the spring is expanded, the spring defining an interior area within at least a portion of the closed loop when the spring is in the uncoiled configuration;

a membrane disposed within the interior area;

a plurality of inflatable bladders being coupled to and disposed circumferentially about at least a portion of the spring; and a sleeve, the plurality of inflatable bladders being disposed within the sleeve.

29. The device of claim 28, further comprising:

a pillow section encapsulating at least one bladder from the plurality of inflatable bladders, the spring being disposed within the sleeve.

30. The device of claim 28, wherein the spring being disposed within the sleeve and outside of the first set of inflatable bladders.

31. The device of claim 28, wherein:

the spring is coupled to the sleeve by the membrane.

32. A device, comprising:

a spring configured to form a closed loop, the spring being moveable between a coiled configuration when the spring is collapsed and an uncoiled configuration when the spring is expanded, the spring defining an interior area within at least a portion of the closed loop when the spring is in the uncoiled configuration;

a membrane disposed within the interior area, the membrane being configured to allow water to flow therethrough; and an inflatable bladder being coupled to and disposed circumferentially about at least a portion of the spring, the device being configured such that a head of a user is buoyantly supported above a remaining portion of the user.

33. The device of claim 32, wherein the membrane is a mesh material.

34. The device of claim 32, wherein the portion of the spring is disposed within the inflatable bladder.

35. The device of claim 32, wherein the spring is disposed outside of and proximate to inflatable bladder.

36. The device of claim 32, the membrane is a first membrane, the device further comprising:

a second membrane folded over the spring and configured to retain the spring; and a sleeve within which the inflatable bladder is disposed.

37. The device of claim 32, the inflatable bladder being a first inflatable bladder, further comprising:

a pillow section configured to encapsulate a second inflatable bladder, the pillow section being coupled to the membrane.

* * * * *

UNITED STATES PATENT AND TRADEMARK OFFICE

CERTIFICATE OF CORRECTION

PATENT NO. : 7,097,524 B2
APPLICATION NO. : 10/295906
DATED : August 29, 2006
INVENTOR(S) : David Arias It is certified that error appears in the above-identified patent and that said Letters Patent is hereby corrected as shown below:

Column 4
Line 3, after "configured to" insert --buoyantly--.

Column 4
Lines 27-28, after "configured to" insert --buoyantly--.

Column 4
Line 51, after "configured to" insert --buoyantly--.

Column 5
Line 23, after "configured to" insert --buoyantly--.

Signed and Sealed this

Twelfth Day of December, 2006

JON W. DUDAS
*Director of the United States Patent and Trademark Office*